US007902977B2

(12) United States Patent
Howe

(10) Patent No.: US 7,902,977 B2
(45) Date of Patent: Mar. 8, 2011

(54) INTEGRATED MULTI-SPECTRUM INTRUSION THREAT DETECTION DEVICE AND METHOD FOR OPERATION

(75) Inventor: Steven Howe, Massapequa, NY (US)

(73) Assignee: Honeywell International Inc., Morristown, NJ (US)

( * ) Notice: Subject to any disclaimer, the term of this patent is extended or adjusted under 35 U.S.C. 154(b) by 633 days.

(21) Appl. No.: 12/035,145

(22) Filed: Feb. 21, 2008

(65) Prior Publication Data

US 2009/0212944 A1 Aug. 27, 2009

(51) Int. Cl.
*G08B 13/00* (2006.01)
*G08B 13/08* (2006.01)

(52) U.S. Cl. ..... 340/541; 340/545.3; 340/545.4; 340/565; 340/566

(58) Field of Classification Search ..... None
See application file for complete search history.

(56) References Cited

U.S. PATENT DOCUMENTS

| | | | | |
|---|---|---|---|---|
| 5,686,885 | A * | 11/1997 | Bergman | 340/514 |
| 2005/0128069 | A1* | 6/2005 | Skatter | 340/522 |
| 2006/0093695 | A1* | 5/2006 | Ueda et al. | 425/150 |
| 2009/0121888 | A1* | 5/2009 | Reeves et al. | 340/669 |
| 2010/0134285 | A1* | 6/2010 | Holmquist | 340/541 |

* cited by examiner

*Primary Examiner* — Julie Lieu
(74) *Attorney, Agent, or Firm* — Husch Blackwell LLP

(57) ABSTRACT

A security apparatus comprising a plurality of sensing elements, each adapted to detect intrusion into protected premises, each sensing element outputs a sensing signal representing a detected event, a signal processing section for examining each sensing signal and outputting a signature for each sensing signal, a computing section for translating each signature into a normalized threat value, ranging from "0" to "1", modifying each normalized threat values by multiplying a weighting coefficient corresponding to a type of sensing element, storing for a temporary period of time, each modified normalized threat value, and an alarm generating section for adding each of the stored modified normalized threat values, outputting an aggregate threat value and generating an alarm enable signal based upon an analysis of the aggregate threat value.

34 Claims, 4 Drawing Sheets

INTEGRATED MULTI-SPECTRUM INTRUSION THREAT DETECTION DEVICE AND METHOD FOR OPERATION

FIELD OF THE INVENTION

The present invention relates generally to security systems and intrusion detection devices. More particularly, the present invention relates to an intrusion detection device with a plurality of peer sensing elements, where the output of each sensing device is used as a basis for determining whether to generate an alarm.

BACKGROUND

False alarms are a significant problem for security systems because the alarms result in a waste of resources. Specifically, a remote monitoring station receives the alarm from the control panel or sensor and commences a response. The response can include calling the local police or fire department. The police or fire department responds by traveling to the protected property and investigating the alarm. Meanwhile, a real emergency might be occurring at other locations. Additionally, there is a potential for a fine or penalty for misuse of police resources. False alarms can be generated as a result of environmental changes, human error, errors in a sensitivity setting and pets moving within a protected area.

U.S. Pat. No. 7,106,193, issued on Sep. 12, 2006 to Kovach and assigned to Honeywell International Inc., describes an alarm detection and verification device. The alarm detection device includes two sensors, a primary sensor and a secondary sensor. The verification device includes a verification sensor such as a video camera. The alarm is first detected and then verified. The detection of alarm condition is based upon a binary decision process, i.e., yes or no. In other words, the detection of an event is an all or nothing decision process.

Similarly, U.S. Pat. No. 4,857,912, issued to Everett Jr. et al., on Aug. 15, 1989, describes a multi sensor security system where the detection of alarm condition at each sensor is based upon an on or off state of the output.

However, using such a decision criterion does not account for the raw data included a sensor output or activity that is just below a detector threshold. False alarms can be generated where the sensor outputs an incorrect "on" or "off" state

SUMMARY OF THE INVENTION

Accordingly, disclosed is a security apparatus comprising a plurality of sensing elements, a signal processing section, a computing section and an alarm generating section. The plurality of sensing elements are adapted to detect intrusion into protected premises. Each sensing element outputs a sensing signal representing a detected event. The signal processing section examines each sensing signal and outputs a signature for each sensing signal. The computing section translates each signature into a normalize threat value, ranging from "0" to "1", modifies each normalized threat values by multiplying a weighting coefficient corresponding to a type of sensing element, and stores for a temporary period of time each modified normalized threat value. The alarm generating section adds each of the stored modified normalized threat value, outputs an aggregate threat value and generates an alarm enable signal based upon an analysis of the aggregate threat value.

The alarm generating section compares the aggregated threat value with a stored master threat threshold value and generates the alarm enable signal if the aggregated threat value is greater than the stored master threat threshold value.

The security apparatus further comprises a storage section for storing each of the modified normalized threat values. The master threat threshold value, the plurality of aging factors for each stored modified threat value, the weighting coefficient for each threat value, and a scaling factor for each signature is stored in the storage section.

The security apparatus further comprises a lifespan determining section for selecting one aging factor from a plurality of aging factors and for adjusting each of the stored modified normalized threat values using the selected aging factor.

The security apparatus further comprises a parameter setting section for changing the master threat threshold value, the plurality of aging factors for each stored modified threat value, the weighting coefficient for each threat value, and a scaling factor for each signature and storing the change in the storage section.

The sensing elements can be any type of sensor, such as a motion sensor, an acoustic sensor and a video imaging device. Each of the sensing elements can be a different type of sensing element.

Also disclosed is a method for operating a security system. The method comprises the steps of monitoring a protected area with a plurality of sensing elements, each of the sensing elements outputs a sensor signal, examining each sensor signal and outputting a signature for each sensor signal; translating each signature into a normalized threat value using a scaling value, adjusting each normalized threat value using a preset weight coefficient that corresponds with the sensing element that output the sensor signal, storing for a temporary period of time, each adjusted normalized threat values, generating an aggregate threat value by adding each of the stored adjusted normalized threat values, and generating an alarm enable signal based upon analysis of the measured threat value. The examination is based upon at least one predefined evaluation criterion for each sensor signal.

Each predefined evaluation criterion varies based upon a type of sensing element. The temporary period of time is variable. The scaling value and the preset weight coefficient is variable.

The generating the alarm enable signal comprises the substep of comparing the aggregate threat value with a master alarm threshold value. The master alarm threshold value can be set during installation. Additionally, the master alarm threshold value can be remotely modified. The modification to the master alarm threshold value can be based on a historical analysis of the master threat value.

The method for operating a security system further comprises the step of aging each of the stored adjusted normalized threat values using a selected aging factor.

The aging step comprises the substeps of starting a timer for each stored adjusted normalized threat value when each stored adjusted normalized threat value is stored and multiplying each of the stored adjusted normalized threat value by a time-to-live value. The time-to-live value is "1" when the time that the stored adjusted normalized threat value is less than a preset period of time and "0" when the time that the stored adjusted normalized threat value is greater than a preset period of time.

Alternatively, the aging step comprises the substeps of starting a timer for each stored adjusted normalized threat value when each stored adjusted normalized threat value is stored, each timer outputting a time value and multiplying each of the stored adjusted normalized threat value by a decreasing time coefficient. The decreasing time coefficient is related to the time value.

Alternatively, the aging step comprises the substep of multiplying each of the stored adjusted normalized threat value by a weighting coefficient. The weighting coefficient is "1" until the stored adjusted normalized threat value is acknowledged and "0" after the stored adjusted normalized threat value is acknowledged.

The method for operating a security system further comprises the step of selecting the aging factor from a group of aging factors being a time-to-live value, a decreasing time coefficient and a "0"/"1" acknowledgement coefficient.

The decreasing time coefficient is variable based upon the sensor element technology and the anticipated activity within the protected area. The decreasing time coefficient can be set during installation. Additionally, the decreasing time coefficient is periodically adjusted. The decreasing time coefficient can be set remotely. The remote setting is via a wired or wireless communication network.

The method for operating a security system further comprises the step of deleting a prior adjusted normalized threat value when a more recent larger adjusted normalized threat value is stored for a same sensing element.

The steps of monitoring, examining, translating, adjusting and storing for each sensing element are performed in parallel.

BRIEF DESCRIPTION OF THE DRAWINGS

These and other features, benefits, and advantages of the present invention will become apparent by reference to the following text and figures, with like reference numbers referring to like structures across the view, wherein.

DETAILED DESCRIPTION OF THE INVENTION

Figure 1:
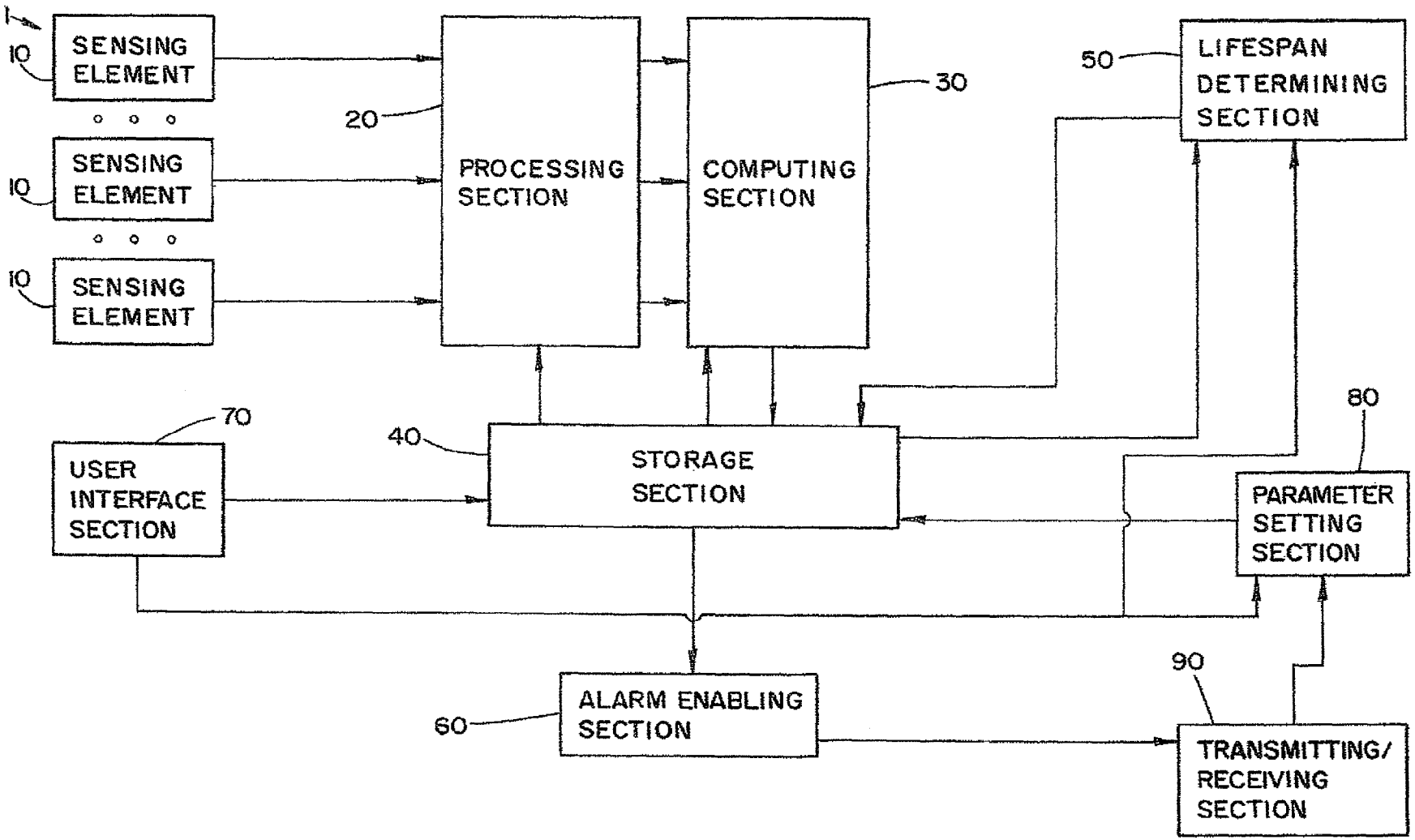
FIG. 1 is a block diagram of the security device in accordance with an embodiment of the invention.

The security device 1 also includes a processing section 20. The processing section 20 is adapted to output a signature representing a detected event. The processing section 20 may be implemented by a microprocessor, ASIC, dedicated logic and analog circuits or as a combination thereof as is well known in the art. The signature is different for each sensing element 10. The processing section 20 is electrically coupled to each of the sensor elements 10. As depicted in FIG. 1, the process section 20 is a single block, however, in an embodiment of the invention, each sensing element 10 has its own processing section 10. Since the type of processing needed for each sensing element 10 can be different, each processing section 20 can be different as well. The specific structure of the processing section 20 is dependent upon the type of sensing element.

For example, if the sensing element 10 is a PIR sensor, the sensor output is a voltage change, in a specific bandwidth. The voltage change will have specific characteristics, i.e., amplitude and frequency. The processing section 10 will include an amplifier with a variable gain and a signal filter. The processing section 10 receives the sensor signal from the sensing element 10 as an input and a predefined threat signature from storage. Additionally, the processing section 10 can also receive, as an input, a gain and filter adjustment signal. The threat signature represents known characteristic information for motion in the thermal spectrum. The processing section 10 compares the threat signature with an amplifier filtered sensor signal.

If the sensing element 10 is a glass break detection device with a microphone, the sensor output is a voltage change in a different bandwidth than the PIR sensor. The processing section 10 will include an amplifier with a variable gain and a signal filter. The processing section 10 receives the sensor signal from the sensing element 10 as an input and a predefined threat signature from storage. Additionally, the processing section 10 can also receive, as an input, a gain and filter adjustment signal. The threat signature represents known characteristic information for vibration or sound in the glass tuned spectrum. The processing section 10 compares the threat signature with the amplifier filtered sensor signal If the sensing element 10 is an acoustic detection device, with a microphone and an audio CODEC, the sensor output is a voltage change in a different bandwidth, than the PIR sensor or glass break device. The processing section 10 will include an amplifier with a variable gain and a signal filter The processing section 10 receives the sensor signal from the sensing element 10 as an input and a predefined threat signature from storage. Additionally, the processing section 10 can also receive, as an input, a gain and/or filter adjustment signal. The threat signature represents known characteristic information for ambient sound in the human auditory spectrum. The processing section 10 compares the threat signature with the amplifier filtered sensor signal.

If the sensing element 10 is video surveillance device, with a CMOS imager and an image capture device, the sensor output is a video image. The image capture device includes exposure, contrast and a frame rate control section. The processing section 10 is adapted to process video motion data. The processing section 10 includes a temporary buffer for storing frames of the image data. The processing section 10 also receives as an input an inclusion and exclusion zone parameters which causes the processing section 10 examine specific zones within the image and ignore other zones. Additionally, the processing section 10 receives an object profile information and trajectory information for potentially threatening images. The profile and trajectory information effectively is a threat signature. The processing section 10 compares the threat signature with the processed image data.

The security device 1 further includes a computing section 30. The computing section 30 is electrically coupled to the processing section 20 and receives as input the signature. The computing section 30 converts or translates the signature into a normalized value or "threat value". The normalize value ranges from zero to one. The normalized value is based on a result of the comparison of the threat signature with the processed signature. Known threatening activity, e.g., processed amplitudes close the threat signature would have a normalized value close to 1. Processed signature that are not very close, e.g., amplitude very low, would have a normalized value close to 0. The computing section 30 also receives as input a scaling factor. The computing section 30 to translate the input signature into the normalized value uses the scaling factor.

Additionally, the computing section 30 adjusts the normalized value (threat value) according to the type of sensing element 10 using a threat adjustment value. The threat adjustment value is input to the computing section 30. The threat adjustment value is assigned to a sensing element 10 in advanced. The threat adjustment value is a value between 0 and 1. The threat adjustment value is multiplied by normalized value. The threat adjustment value is assigned to account for the reliability of the sensing element 10, e.g., is the sensing element 10 subject to false alarms or is it easily fooled, such as by pets. The larger the threat adjustment value, e.g., closer to 1, the more influence the sensing element 10 has on the aggregate threat value and ultimately on the generation of an alarm enable signal. The computing section 30 outputs an adjusted threat value.

The security device 1 also includes a storage section 40. The storage section 40 is adapted to store the adjusted threat value output by the computing section 30. Additionally, preset or predefined sensor path parameters are store in the storage section 40. For example, sensitivity adjustment data such as gain and filtering parameters is stored in the storage section 40. Additionally, the computing parameters such as the scaling factor and threat adjustment value is stored in the storage section. These parameters are indexed by the sensing element 10 or sensor path.

The stored threat values are continually added together to obtain a master or aggregate threat value. Since the threat values are continually updated and added, the security device 1 accounts for time expiration by depreciating the stored threat value. This ensures that the threat values are not added infinitium or stale threat values used.

The security device 1 uses a lifespan determining section 50 to modify the stored threat value. The lifespan determining section 50 is described in FIG. 2. The security device 1 further includes an alarm enabling section 60. The alarm enabling section 60 is constructed to add each of the stored threat value and obtain an aggregate threat value. The alarm enabling section 60 stores the aggregate threat value in the storage section 40. Additionally, in an embodiment, the alarm enabling section 60 causes the aggregate threat value to be transmitted to a remote monitor section. The likelihood that an intrusion has occurred increases with an increase in the aggregate threat value. Additionally, the alarm enabling section 60 retrieves a master threat threshold value which is stored in the storage section 40. The master threat threshold value is preset, but use can be varied. The master threat threshold value is used as a basis of comparison for a threat assessment. A high master threat threshold value is used when a desired sensitivity is low. A high master threat threshold value is also used when a strong verification across all sensing elements 10 is needed. For example, a high master threat threshold value is used in a residence with pets.

A low master threat threshold value is used when a desired sensitivity is high. For example, a low master threshold can be used in governmental and industrial environments. The alarm enabling section 60 compares the master threat threshold value with the aggregate threat value. If the aggregate threat value is greater than the master threat threshold value, an alarm enable signal is generated by the alarm enabling section 60. The alarm enabling section 60 may be implemented by a microprocessor, ASIC, dedicated logic and analog circuits as a combination thereof as is well known in the art.

As described above, the security device 1 has several parameters that are preset or predetermined. Each of these parameters is set to a factory default. The parameters can be adjusted or changed during installation to customize the system for the environment. The security device 1 includes a user interface section 70 or device. In an embodiment, the user interface section 70 includes configuration switches and possible display. An installer can actuate the configuration switches to modify or set each of the parameters. In another embodiment, the user interface section 70 includes communications interface adapted such that a configuration device can be coupled to the security device 1.

In one embodiment, the parameter adjustments are directly stored in the storage section 40 using the user interface section 70. In another embodiment, a parameter setting section 80 stores the parameter adjustments. The parameter setting section 80 converts the data input in the user interface section 70 into a format for storage and writes the data into the storage section 40, indexed by sensor path or sensing element 10. Additionally, the master threat threshold value is separately stored.

In another embodiment, the parameters are remotely updated or changed. For example, a remote monitoring station can monitor historical data of the aggregate threat values and modify each sensor path parameter The remote monitoring station send control signals to the security device 1 via a transmitting and receiving section 90. In an embodiment, the transmitting and receiving section 90 is a wired communications path. In another embodiment, the transmitting and receiving section 90 is a wireless transceiver. Historical data is transmitted to the remote monitoring station by the transceiver.

When the remote monitoring station transmits new or updated parameters to the security device 1, the parameter setting section 80 replaces the old parameters in the storage section 40 with the updated parameters.

In another embodiment, the parameters can be periodically changed based upon a preset schedule (time and day) or a status of a security system. For example, the security device 1 can be programmed with multiple master threat threshold values, one value corresponding to each security system status, such as armed, armed-stay or armed-away. In this embodiment, the parameter setting section 80 can modify or change the sensitivity parameters according to the predefined schedule or status. The parameter setting section 80 includes a timing section or a time-of-day clock/calendar, a memory section containing the predefined schedule or status and a controller for changing the parameters stored in the storage section 40.

Figure 2:
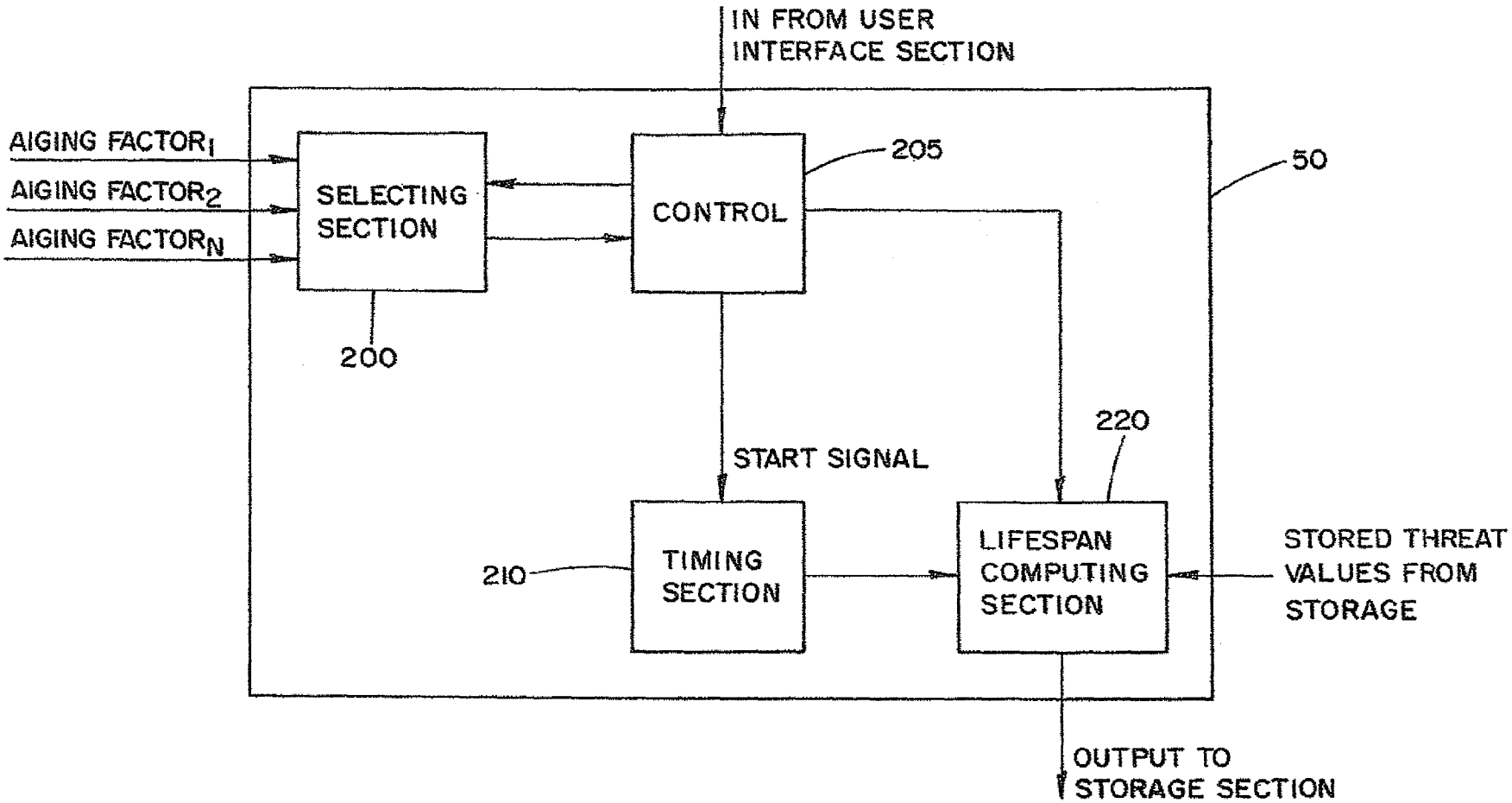
FIG. 2 illustrates a block diagram of a lifespan determining section according to an embodiment of the invention.

FIG. 2 illustrates a block diagram of the lifespan determining section 50. In an embodiment, there are at least three different aging factors to choose from to depreciate the stored threat values: a finite time-to-live (TTL) factor, a gradual decay factor and a hold to acknowledge parameter.

Each of these lifespan parameters or factors is stored in the storage section 40. Additionally, a selection criterion can be stored in the storage section 40. In another embodiment, the parameter setting section 80 inputs the selection criterion to the lifespan determining section 50.

The aging factors ensure there is sufficient time overlap between individual threat values so that a properly weighted threat value can be added together and a proper determination of a threat can be performed. Without a threat lifespan calculation, two otherwise separately occurring (but closely spaced) sensor events, may not be interpreted as related intrusion events with a resulting alarm condition not being reported. Additionally, the aging factors ensure that old or stale threat contributions are discounted or removed over time in order that only timely data is acted upon in a timely manner. Further, the aging factors also ensure that threat values are not accumulated infinitum.

In an embodiment, a time-to-live value is used. The TTL value is either "0" or "1". The TTL is "1" for a predetermined Time-to-Live period and "0" thereafter. The Time-to Live period is application specific and can be varied. In operation, the TTL value is multiplied with the stored threat value with the result being aggregated with other threat lifespan adjusted values.

In another embodiment, a gradual decay factor is used. The decay factor or rate is a discounting value that can be either multiplied or subtracted from the stored threat values in common units of time. The decay factor discounts a threat over time at a fixed time intervals. This process occurs until the threat has reached zero contribution. The decay factor can be linear or non-linear. The decay factor can be varied. Additionally, in an embodiment, the decay factor is sensing element specific. In other words, a different decay factor is used for different sensor types or technologies.

In another embodiment, a hold-to-acknowledge value is also used to account for staleness but forces an external acknowledgement and clear of the stored adjusted threat value. The hold-to-Acknowledge value is either "0" or "1". The hold-to acknowledge value is "1" until the threat value is acknowledged and "0" thereafter. In operation, the hold-to acknowledge value is multiplied with the stored threat value. The hold to acknowledge value is typically used in very high security applications, such as in prison and government applications. Effectively, the hold-to-acknowledge value maintains the same threat value until it is manually acknowledged by a either human operator or an security management system. The acknowledgement is a reset command to clear the threat value from the storage section 40.

In an embodiment, the aging factors are factory set based on product sensor application. In another embodiment, the aging factors and values can adjusted (tweaked) in the field either locally by the installer or remotely on a network by remote technical operator.

Each of the factors is input to lifespan determination section 50. The lifespan determining section 50 selects one of the factors (methods) using a selecting section 200. In an embodiment, the selection section 200 is a mode register. The lifespan determination section 50 further includes a controller 205, a timing section 210 and a lifespan computing section 220.

Each time a threat value is stored in the storage section 40, the controller 205 causes the timing section 210 to start a timer. The timing section 210 contains one timer for each sensing element.

The controller 205 instructs the computing section 220 to retrieve, from the storage section 40, the stored threat values and lifespan values or factors for the selected aging factor.

If the aging factor is a TTL value, the computing section 220 multiples the TTL value by the stored threat values and outputting the adjusted value to the storage section 40. If the aging factor is decay value, the computing section 220 multiples or subtracts the decay value by or from the stored threat values and outputs the adjusted value to the storage section 40 at a preset period of time. If the aging factor is hold-to acknowledge value, the computing section 220 multiples hold-to-acknowledge value by the stored threat values and outputs the adjusted value to the storage section 40.

The computing section 220 determines the actual value for the TTL value i.e. "0" or "1" and decay value based upon the time on the timer for the specific stored threat value. As described above, the TTL value equals 1 before the expiration of a predetermined period of time and equals 0 thereafter. The predetermined period of time is stored in the storage section 40 and accessed by the computing section 220.

The computing section 220 receives the acknowledgement parameter for the hold-to-acknowledge using information input into the user interface section 70 or received from a remote monitoring station, e.g. "0" or "1".

Figure 3:
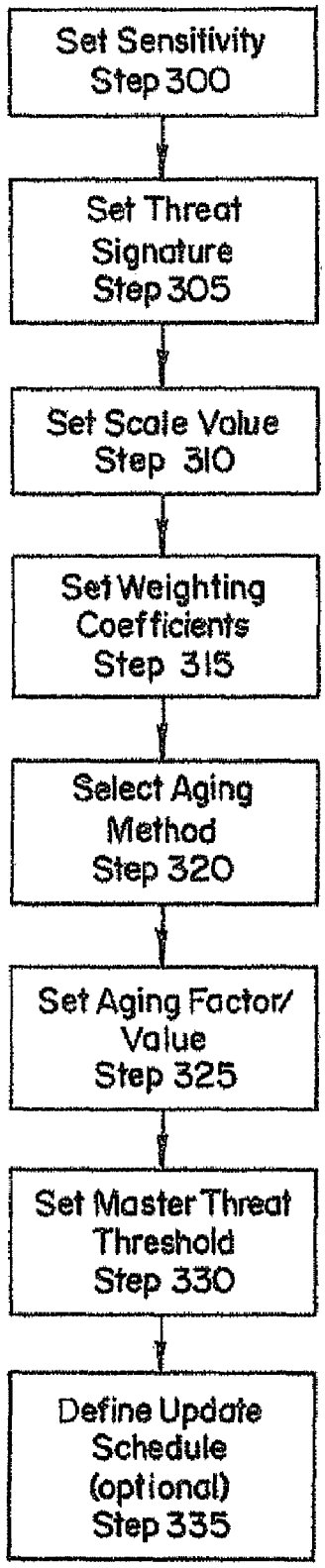
FIG. 3 illustrates a method for configuring the security device in accordance with the invention.

FIG. 3 illustrates a method for configuring the security device 1. As described above, many of the operating parameters are variable. The parameters are initially set to a factory default. The parameters can be customized to a particular environment during installation using the user interface section 70. Additionally, the parameters can be later modified, either on-site or remotely. A remote monitoring station can periodically or as needed transmit updates to the parameters. The parameter setting section 80 stores the updated parameters in the storage section 40. As shown in FIG. 3, each step represents the setting of one type of parameter. Steps 300-325 are repeated for each sensing element 10 or sensor path. In other words, the parameters are sensing element 10 specific. Additionally, FIG. 3 depicts a step for setting each type of parameter. However, during installation or at a later period of time, each type of parameter need not be set. The factory default for a parameter can be used instead. Furthermore, the order for setting the parameters can be changed from the order depicted in FIG. 3.

At step 300, the sensitivity of each sensing element 10 is set. The sensitivity includes parameters like gain, frame rates, exposure control, and illumination control factors. At step 305, the threat signature adjuster or signature threshold is set for each sensing element. The signature threshold includes parameters like peek or average amplitude, frequency bandwidth, object profile and inclusion and exclusion zones and object trajectory. At step 310, the scaling value or factor is set. The scaling value is used to normalize the signature. At step 315, the weighting coefficients are set for each sensing element 10 or sensor path. The weighting coefficient is multiplied by the threat value to determine how much weight is given to a particular sensor. The larger the weighting coefficient, the higher weight is given to the particular sensor and the more influence the sensing element 10 has on the generation of an alarm.

At steps 320 and 325 parameters relating to the depreciation of the stored threat values are set. First, at step 320 the type of aging parameter is selected from multiple options. As described above, the options can be a TTL factor, a gradual decay factor or a hold-to-acknowledge parameter. Second, once the type is selected, the factor is set. For example, if the TTL value is selected, a period of time is determined, where the TTL value switches from "1" to "0".

If the decay factor is selected, the decay function is determined. The decay function can be an exponential decay function, a linear decay function or a step function. Decay function can be multiplied by the stored threat value or subtracted therefrom. At step 330, the master or aggregate threat threshold value is determined. The master threat threshold value is used to determine whether to generate an alarm enable signal.

Additionally, as described above, a schedule can be created such that the parameters are automatically adjusted. The schedule can be based upon a specific time or a status of a security device. At step 335, an optional schedule is created. The schedule is in the form of a table. The table is indexed by sensing element 10 or sensor path along with current time and date. The table includes all options for each parameter and when to selected each option.

Figure 4:
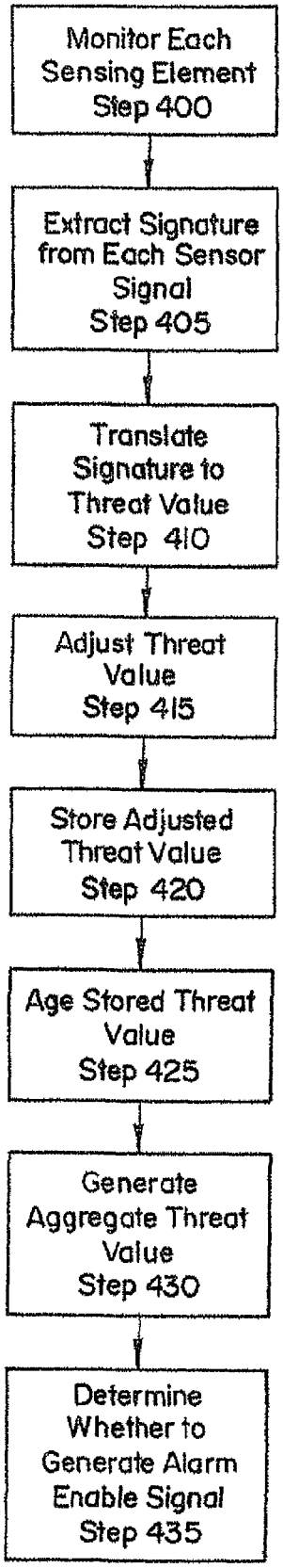
FIG. 4 illustrates a method for operating the security device in accordance with the invention.

FIG. 4 illustrates a method for operating the security device 1 according to an embodiment of the invention.

At step 400, the sensing elements 10 are continuously monitored for a sensor output. The sensor output is different for each sensing element 10. The sensing elements 10 monitor multiple spectrums. At step 405, the sensor output is examined and a signature pattern is extracted from the sensor output. The examination is different for each sensing element. The examination also compares the sensor output with known characteristic corresponding to a detected event, e.g., a signature threshold or threat signature.

At step 410, the signature output by the processing section 20 is translates into a normalized value. The normalize value ranges from zero to one. At step 415, the normalized threat value is adjusted by a weighting coefficient. The weighting coefficient is dependent upon the sensing element 10 that output the sensor signal 10. At step 420, the adjusted threat value is stored in the storage section 40. The storage is temporary. The stored threat value is depreciated over time, using a preselected aging technique, at step 425. If a new sensor signal is generated by a sensing element 10 where a threat value is already stored in the storage section 40, the computing section 30 compares the new threat value with the stored threat value, the higher value is stored, while the lower value is deleted. Steps 400-425 are performed in pararrel and concurrently for each sensing element 10 or sensor path. At step 430, each of the stored threat values is added to obtain an aggregate threat value. The aggregate threat value represents an entire threat picture for all of the sensing elements 10. The aggregate threat value is continuously generated.

At step 435, a determination is made whether to generate an alarm enable signal. The aggregate threat value is compared with the master threat threshold value, which is programmable. If the aggregate threat value is greater than the master threat threshold value, an alarm enable signal is generated. The alarm enable signal is transmitted to a remote monitoring station for processing. Additionally, in an embodiment, the alarm enable signal is transmitted to a security system control panel.

In an embodiment, the aggregate threat value is transmitted to a remote monitoring station for processing and analysis. The remote monitoring station uses historical data of the aggregate threat value to adjust the master threat threshold value. For example, a time series analysis can be performed on the aggregate threat value to determine the master threat threshold value. As with all of the parameters, the master threat threshold is set with a factory default value.

The invention has been described herein with reference to particular exemplary embodiments. Certain alternations and modifications may be apparent to those skilled in the art, without departing from the scope of the invention. The exemplary embodiments are meant to be illustrative, not limiting of the scope of the invention, which is defined by the appended claims.

What is claimed is:

1. A method for operating a security system comprising the steps of:

monitoring a protected area with a plurality of sensing elements, each of the sensing elements outputs a sensor signal;

examining each sensor signal using at least one predefined evaluation criterion for each sensor signal and outputting a signature for each sensor signal;

translating each signature into a normalized threat value using a scaling value;

adjusting each normalized threat value using a preset weight coefficient that corresponds with the sensing element that output the sensor signal;

storing for a temporary period of time, each adjusted normalized threat values;

generating an aggregate threat value by adding each of the stored adjusted normalized threat values; and generating an alarm enable signal based upon analysis of the measured threat value.

2. The method for operating a security system according to claim 1, wherein said at least one predefined evaluation criterion varies based upon a type of sensing element.

3. The method for operating a security system according to claim 1, wherein the temporary period of time is variable.

4. The method for operating a security system according to claim 1, further comprising the step of:

aging each of the stored adjusted normalized threat values using a selected aging factor.

5. The method for operating a security system according to claim 4, wherein aging step comprises the substeps of:

starting a timer for each stored adjusted normalized threat value when each stored adjusted normalized threat value is stored; and multiplying each of the stored adjusted normalized threat value by a time-to-live value, said time-to-live value being "1" when the time that the stored adjusted normalized threat value is less than a preset period of time and "0" when the time that the stored adjusted normalized threat value is greater than a preset period of time.

6. The method for operating a security system according to claim 4, wherein aging step comprises the substeps of:

starting a timer for each stored adjusted normalized threat value when each stored adjusted normalized threat value is stored, each timer outputting a time value; and multiplying each of the stored adjusted normalized threat value by a decreasing time coefficient, said decreasing time coefficient being related to the time value.

7. The method for operating a security system according to claim 4, wherein aging step comprises the substep of:

multiplying each of the stored adjusted normalized threat value by a weighting coefficient, said weighting coefficient being "1" until the stored adjusted normalized threat value is acknowledged and "0" after the stored adjusted normalized threat value is acknowledged.

8. The method for operating a security system according to claim 4, further comprising the step of selecting the aging factor from a group of aging factors being a time-to-live value, a decreasing time coefficient and a weighting coefficient.

9. The method for operating a security system according to claim 8, wherein said decreasing time coefficient is variable based upon a type of sensing element.

10. The method for operating a security system according to claim 8, wherein said decreasing time coefficient is set during installation.

11. The method for operating a security system according to claim 8, wherein said decreasing time coefficient is periodically adjusted.

12. The method for operating a security system according to claim 1, further comprising the step of:

deleting a prior adjusted normalized threat value when a more recent larger adjusted normalized threat value is stored for a same sensing element.

13. The method for operating a security system according to claim 1, wherein the generating the alarm enable signal comprises the substep of comparing the aggregate threat value with a master alarm threshold value.

14. The method for operating a security system according to claim 13, wherein said master alarm threshold value is remotely modified.

15. The method for operating a security system according to claim 13, wherein said master alarm threshold value is set during on premise installation.

16. The method for operating a security system according to claim 14, wherein said modification to the master alarm threshold value is based upon historical analysis of the master threat value.

17. The method for operating a security system according to claim 1, wherein the steps of monitoring, examining, translating, adjusting and storing for each sensing element are performed in parallel.

18. The method for operating a security system according to claim 1, wherein the scaling value and the preset weight coefficient is variable.

19. The method for operating a security system according to claim 8, wherein the decreasing time coefficient is set remotely.

20. The method for operating a security system according to claim 19, wherein the remote setting is via a wireless communication network.

21. A security apparatus comprising:

a plurality of sensing elements, each adapted to detect intrusion into protected premises, each sensing element outputs a sensing signal representing a detected event;

a signal processing section for examining each sensing signal and outputting a signature for each sensing signal;

a computing section for translating each signature into a normalize threat value, ranging from "0" to "1", modifying each normalized threat values by multiplying a weighting coefficient corresponding to a type of sensing element, and storing for a temporary period of time, each modified normalized threat value; and an alarm generating section for adding each of the stored modified normalized threat value, outputting an aggregate threat value and generating an alarm enable signal based upon an analysis of the aggregate threat value.

22. The security apparatus of claim 21, further comprising a storage section for storing each of the modified normalized threat values.

23. The security apparatus of claim 22, further comprising a lifespan determining section for selecting one aging factor from a plurality of aging factors and for adjusting each of the stored modified normalized threat values using the selected aging factor.

24. The security apparatus of claim 23, wherein the alarm generating section compares the aggregated threat value with a stored master threat threshold value and generates the alarm enable signal if the aggregated threat value is greater than the stored master threat threshold value.

25. The security apparatus of claim 24, wherein the master threat threshold value, the plurality of aging factors for each stored modified threat value, the weighting coefficient for each threat value, and a scaling factor for each signature is stored in the storage section.

26. The security apparatus of claim 25, further comprising a parameter setting section for changing the master threat threshold value, the plurality of aging factors for each stored modified threat value, the weighting coefficient for each threat value, and a scaling factor for each signature and storing the change in the storage section.

27. The security apparatus of claim 21, wherein at least one of the plurality of sensing elements is a motion sensing element for sensing motion within the protected premises.

28. The security apparatus of claim 21, wherein the motion sensing element is a passive infrared sensing element.

29. The security apparatus of claim 21, wherein the motion sensing element is a microwave motion sensing device.

30. The security apparatus of claim 21, wherein at least one of the plurality of sensing elements is an acoustic sensing element for sensing sound or vibrations within the protected area.

31. The security apparatus of claim 30, wherein said acoustic sensing element is microphone and an audio CODEC device.

32. The security apparatus of claim 30, wherein said acoustic sensing element is glassbreak sensing device.

33. The security apparatus of claim 21, wherein at least one of the plurality of sensing elements is an video imaging device.

34. The security apparatus of claim 21, wherein each of the plurality of sensing elements is a different type of sensing element.

* * * * *